United States Patent [19]

Macaluso

[11] Patent Number: 4,735,283

[45] Date of Patent: Apr. 5, 1988

[54] MUFFLER WITH FLOW DIRECTOR PLATES

[75] Inventor: Howard C. Macaluso, Jackson, Mich.

[73] Assignee: Tenneco Inc., Lincolnshire, Ill.

[21] Appl. No.: 937,835

[22] Filed: Dec. 4, 1986

[51] Int. Cl.[4] ..... F01N 1/08

[52] U.S. Cl. ..... 181/265; 181/266; 181/272

[58] Field of Search ..... 181/265, 266, 272

[56] References Cited

U.S. PATENT DOCUMENTS

| | | | |
|---|---|---|---|
| 2,070,543 | 2/1937 | Cary et al. | 181/266 |
| 2,182,945 | 12/1939 | Gunn | 181/265 |
| 3,590,947 | 7/1971 | Latch et al. | 181/266 |
| 4,143,739 | 3/1979 | Nordlie | 181/265 |
| 4,164,989 | 8/1979 | Lux et al. | 181/265 |
| 4,220,219 | 9/1980 | Flugger | 181/265 |
| 4,381,045 | 4/1983 | Buchwalder | 181/265 |
| 4,467,887 | 8/1984 | Vizod | 181/265 |

*Primary Examiner*—Benjamin R. Fuller

[57] ABSTRACT

A retroverted flow type exhaust gas muffler has curved flow directing and guiding plates mounted on end headers to facilitate flow reversal.

8 Claims, 3 Drawing Sheets

MUFFLER WITH FLOW DIRECTOR PLATES

BACKGROUND OF THE INVENTION

A widely used acoustic muffler design for motor vehicle exhaust gas systems has a retroverted gas flow path in which gas flows to the downstream end of the muffler, reverses itself to flow to the upsteam end of the muffler, and reverses itself again to flow back to the downstream end and out of the muffler. In some of the mufflers of this type means are provided to guide and direct the flow reversal at the downstream and/or upstream end of the muffler. Curved surfaces formed in one or both of the end headers of the muffler have been used, for example, to provide such means as shown in U.S. Pat. No. 4,381,045, issued Apr. 26, 1983. Turnaround cups mounted on internal partitions to connect the outlet end of one gas conduit to the inlet end of another have also been used to provide such means as shown in U.S. Pat. Nos. 2,182,945 issued Dec. 12, 1939, and 2,934,161, issued Apr. 26, 1960.

BRIEF SUMMARY OF THE INVENTION

It is the purpose of the invention to improve the performance of low back pressure acoustic mufflers by providing a means to efficiently guide and direct gas flow reversal at one or both ends of the muffler. The invention accomplishes this purpose through the use of a curved plate mounted on an end header in spaced relationship to the ends of the gas flow passages.

DETAILED DESCRIPTION OF THE EMBODIMENTS OF THE INVENTION

Figure 1:
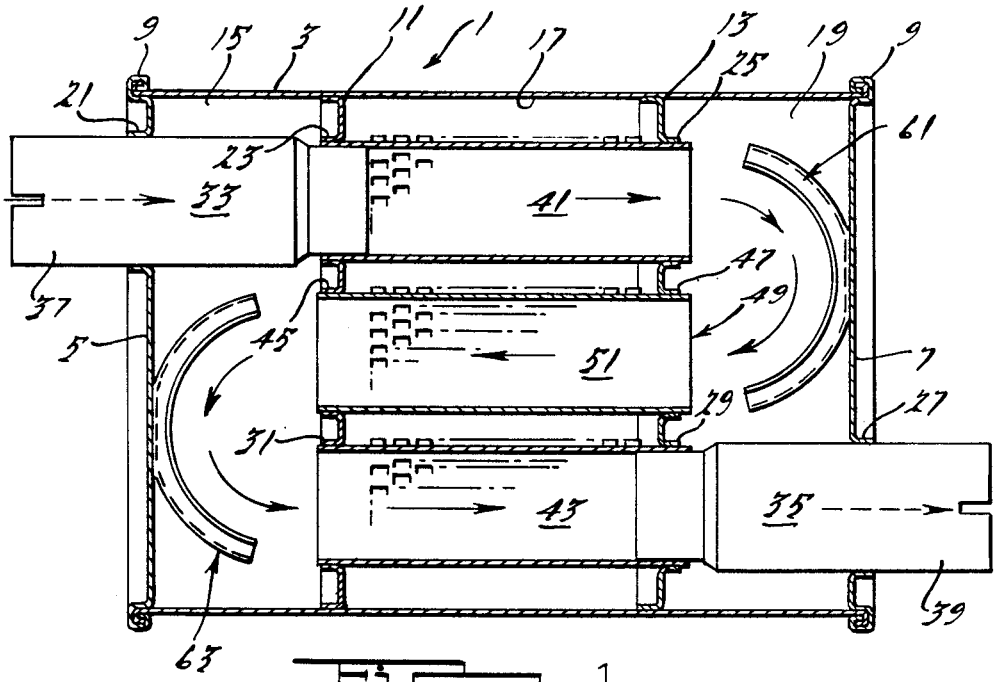
FIG. 1 is a longitudinal cross section through an acoustic muffler embodying the invention.
Figure 2:
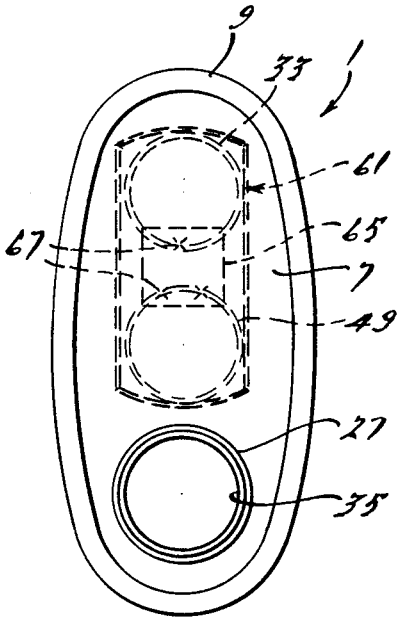
FIG. 2 is an end elevation taken from the right of FIG. 1.
Figure 3:
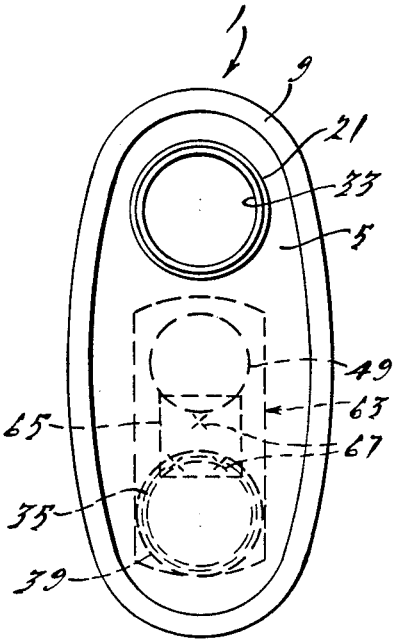
FIG. 3 is an end elevation taken from the left of FIG. 1.

Referring to FIGS. 1–3, a muffler 1 has a tubular sheet metal shell 3 of oval cross section which is closed at its left end by a sheet metal header 5 and at its right end by a sheet metal header 7, the outer edges of the headers being interlocked with the ends of the shell 3 to form gas tight joints 9.

Positioned inside of the shell 3 are longitudinally separated transverse partitions 11 and 13 which act as transverse wall means with each other and with the headers 5 and 7 to subdivide the interior of the muffler into a left end chamber 15, a central chamber 17, and a right end chamber 19. The header 5 and the partitions 11 and 13 have aligned openings defined by annular flanges or collars 21, 23, and 25, respectively; and the header 7 and the partitions 13 and 11 have aligned openings defined by annular flanges or collars 27, 29, and 31, respectively. A first gas flow tube 33 extends through collars 21, 23, and 25 to provide a straight line path for gas to flow between the outside of the muffler and chamber 19, the tube sections being secured by welding or the like to the collars. A second gas flow tube 35 parallel to tube 33, extends through collars 27, 29, and 31 to provide a straight line path for gas to flow between the outside of the muffler and chamber 15 and the two sections of this tube are also affixed to certain or all of the collars. The sections 37 and 39, respectively, of the tubes 33 and 35 which are outside of the housing provided by shell 3 and headers 5 and 7 serve as bushings for connection by clamping or otherwise to conduits (not shown) in an exhaust gas system.

The portions 41 and 43, respectively, of the tubes 33 and 35 which are between partitions 11 and 13 (i.e., in chamber 17) are perforated, preferably by means of louvers as illustrated, to provide for acoustic communication and gas flow between the insides of the tubes and the chamber.

The partitions 11 and 13 have aligned openings defined by annular collars 45 and 47 located substantially on the center line or axis of the shell 3 and equal distances from tubes 33 and 35. A third gas flow tube 49 extends through collars 45 and 47 to provide a straight line path for gas to flow between chambers 15 and 19, the tube being secured by welding or the like to one or both of the collars. The portion 51 of the gas flow tube 49 between partitions 11 and 13 (i.e., in chamber 17) is perforated, preferably by means of louvers as illustrated, to provide for acoustic communication and gas flow between the inside of the tube and the chamber. A glass fiber pack (not shown) may be used in chamber 17 to help provide a mellow sound. For example, a layer of glass fibers (not shown) may be wrapped around the inner circumference of chamber 17 (around tubes 33, 35, and 49) to enhance sound attenuation.

Figure 7:
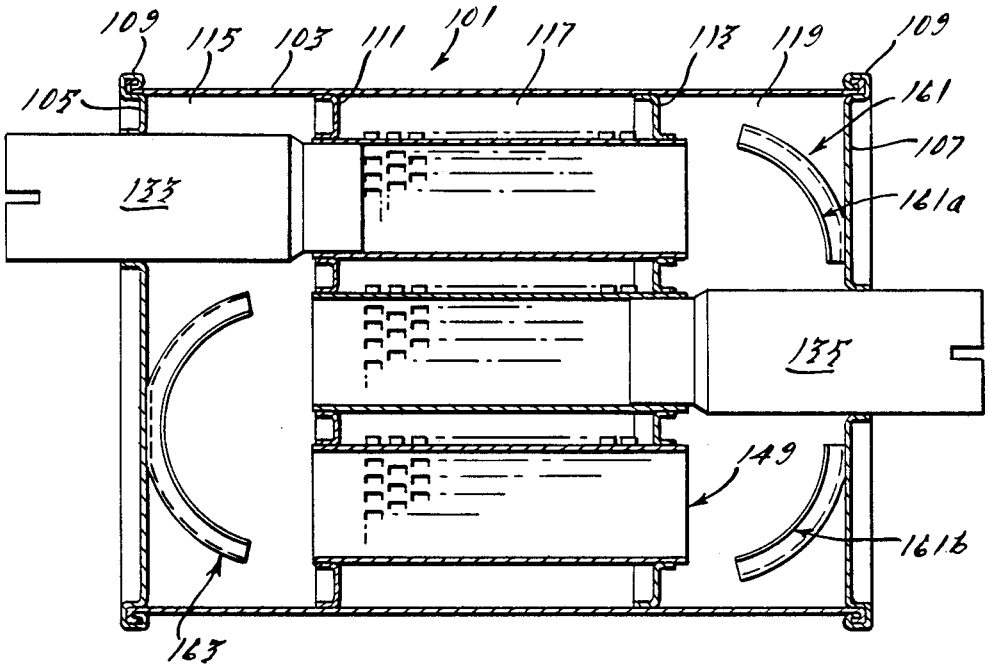
FIG. 7 is a longitudinal cross section through another acoustic muffler embodying the invention.
Figure 8:
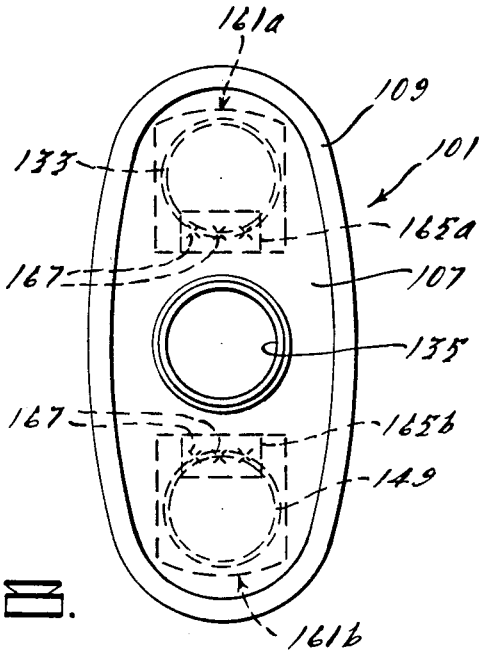
FIG. 8 is a side elevation taken from the right of FIG. 7.

FIGS. 7 and 8 show a second embodiment of the invention in the form of a muffler 101. This will be only sketchly described because in most particulars it is the same as muffler 1. The difference is in the location of the tubes which extend to the outside of the muffler housing. In muffler 1 they are at opposite sides of the oval cross section. In muffler 101, one of the tubes is at the side and the other is on the center line. As will be seen, this affects the means for guiding and directing flow reversal.

In muffler 101, there is a shell 103 and end headers 105 and 107 connected to the shell in interlocked joints 109. Transverse internal partitions 111 and 113 act with the end headers to subdivide the space inside shell 103 into chambers 115, 117, and 119. A first gas flow tube 133 extends through end header 105 and the partitions to connect the outside of the muffler to chamber 119. A second gas flow tube 135 extends throught he end header 107 and the partitions to connect the outside of the muffler to chamber 119. A second gas flow tube 135 extends through the end header 107 and the patitions to connect the outside of the muffler to chamber 115. Tube 135 is the counterpart of tube 35 in muffler 1 but is located on the center line of muffler 101. A third gas flow tube 149 is supported on partitions 111 and 113 and provides for gas flow between chambers 115 and 119.

Assuming that the left end of the muffler 1 is the inlet side (though it could be the reverse) gas entering tube 33 can flow straight down the tube into end chamber 19. It can escape from chamber 19 by reversing direction and flowing back toward the left or inlet or upstream end through tube 49 straight through to end chamber 15. It can escape from chamber 15 by reversing direction and flowing through tube 35 toward the downstream end and out of the muffler 1. Gas in tube sections 41, 43, and 51 can communicate with the chamber 17 through the perforations or louvers and cross flow or by pass flow between the chamber 17 and tubes can occur. Gas entering the chamber 19 from tube 33 and chamber 15 from tube 49 encounters an abrupt enlargement of its flow path as does gas leaving the tubes to enter chamber 17 through the louvers. These and other acoustic mechanisms at work in the muffler serve to remove substantial amounts of energy from the gas and to provide significant acoustic attenuation of a wide range of sound frequencies. Muffler 101 operates and functions in the same way as muffler 1.

While the abrupt changes in size of the path for gas between the tubes 33, 35, and 49 and the end chambers 15 and 19 are beneficial in terms of sound reduction, they do tend to produce turbulence and increased back pressure in the muffler. As a means of retaining such acoustic benefits and improving low back pressure performance of the muffler, the invention provides special pressed sheet metal flow reversal plates 61 and 63 to guide and direct flow of the gas in chambers 19 and 15, respectively. Plates 61 and 63 are substantially identical and as seen best in FIG. 1 and 4–6 are curved to be substantially arcs of a circle having centrally located preferably square, back, flat portions 65 to serve as means for fitting against and welding the plates to the inside faces of end headers 7 and 5, respectively, as indicated by the "x's" 67 in FIGS. 2 and 3. The height of each plate 61 and 63 (i.e., the overall distance between the flat 65 and the ends of the curve) is preferably about one half the length of the chamber 19 or 15 in which it is located.

The length of the inaginary chord subtending the arc of plates 61 is, as revealed in FIG. 1, about the same as the maximum distance between the outer peripheries of tube portions 41 and 51; and the length of the imaginary chord subtending the arc of plate 63 is about the same as the maximum distance between the outer peripheries of tube portions 51 and 43 (these chords being of the same length in the construction illustrated). The plate 61 is welded to header 7 in a centered position with respect to the two tubes 33 and 49, as can be seen in FIG. 1; while the plate 63 is welded to header 5 in a centered position with respect to the two tubes 49 and 35. Thus, each of plates 61 and 63 may be regarded as having an inlet portion aligned longitudinally with the outlet of a tube or flow passage and an outlet portion aligned longitudinally with the inlet of another tube or flow passage.

Figure 4:
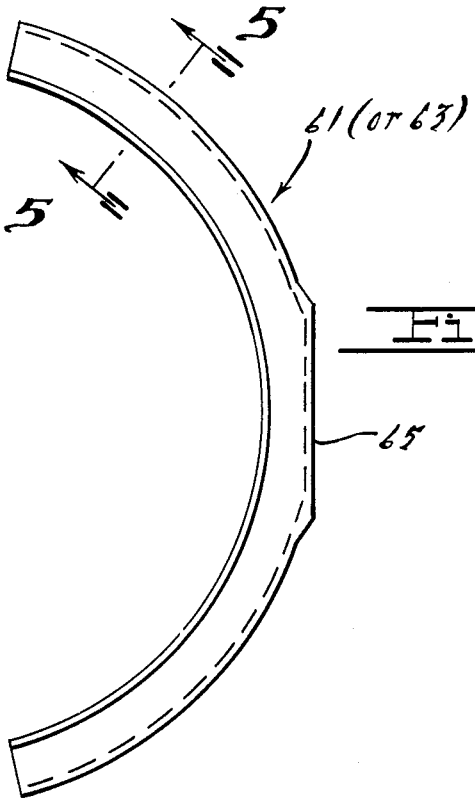
FIG. 4 is a side elevation of the flow guiding and directing cup used in the muffler of FIGS. 1–3.
Figure 5:
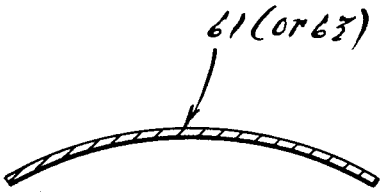
FIG. 5 is a cross section along the line 5—5 of FIG. 4.
Figure 6:
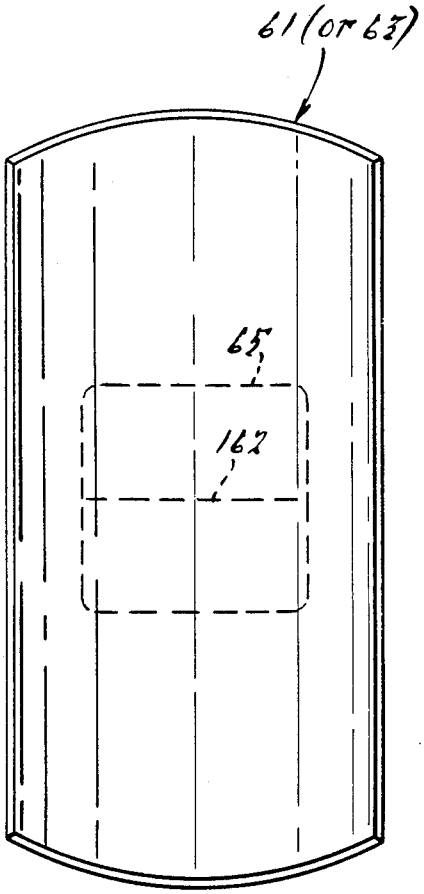
FIG. 6 is a front view taken from the left of FIG. 4.

The plates 61 and 63 are curved in cross section (except for the flat portion 65) as seen best in FIG. 5. The concave side is presented to the gas flow. This curvature is preferably a circular arc formed on a radius substantially the same as the overall radius of curvature of the cup, i.e., the side elevation as seen in FIGS. 1 and 4. The chordal widths of the arcuate cross sections of plates 61 and 63 are preferably somewhat greater than the larger diameter of the gas flow tubes with which they are aligned. For example, if the tubes 33 and 49 are both 2¼" O.D., the plate 61 is preferably 2½" wide. The curved cross section improves both strength of the plate and flow of gas. Again, the plates 61 and 63 are welded on their headers so that they are centered with respect to their tubes in direction along both the major and minor axes of the oval cross section.

In operation, the curved plate 61 will serve to direct and guide gas leaving tube 33 so that it reverses itself more efficiently to flow into tube 49. Similarly, curved plate 63 will serve to direct and guide gas leaving tube 49 so that it reverses itself more efficiently to flow into tube 35. The flow arrows in FIG. 1 symbolize the flow direction and guidance which will tend to decrease back pressure in the retroverted flow design.

In muffler 101 of FIGS. 7–8, the curved plate 163 for chamber 115 can be the same as plate 63. However, the axial location of tube 135 prevents use of a one piece, flow director such as plate 61. However, the plate 61 can be bisected along the line 162 (FIG. 6) to form two halves **161*a* and 161*b* which have half-back flat portions 165*a* and 165*b*. These can be welded to header 107, as indicated by "x's" 167, on opposite sides of tube 135 to form a flow directing and guiding means 161 that will function to smooth out flow reversal to some extent and therefore have a beneficial effect on back pressure and performance of muffler 101. In this arrangement the half 161a will serve as the inlet or flow receiving portion of the means 161 and the half 161b as the outlet or flow discharge portion of the means 161**.

The curved flow directing and guiding plates shown in FIGS. 1–8 make the two flow reversals in the end chambers very smooth and efficient and therefore promote a low back pressure and high horsepower performance. The flow director plates substantially reduce back pressure as compared with the same mufflers having no plates, and tend to make the mufflers substantially the same as a straight pipe in horsepower delivered. In addition, the designs of mufflers 1 and 101, especially if a glass fiber pack is used in chamber 17 or 117, have excellent sound control due to the attenuation provided by the three chambers and three louvers tubes, the particular designs producing a throaty, mellow sound popular with performance enthusiasts. The structure shown tends to simplify construction and production and to avoid the problem of head ring or drumming associated with gas impingement directly against the headers.

Modifications may be made in the specific structures shown and described without departing from the spirit and scope of the invention.

What is claimed is:

1. In an exhaust gas muffler, a tubular housing having a longitudinal axis, gas flow tubes in the housing extending substanitally parallel to said axis, said housing having a transverse wall means defining a transverse chamber, one of said gas flow tubes providing for gas flow in one direction parallel to said axis and having an outlet opening into said transverse chamber, another of said tubes providing for gas flow in the opposite direction parallel to said axis and having an inlet opening into said transverse chamber, and a gas flow directing and guiding means comprising a curved plate mounted on said wall means in said transverse chamber extending toward and axially spaced from said inlet and outlet for directing and guiding a 180 degree flow reversal of gas in said transverse chamber to flow from said outlet to said inlet.

2. In a muffler as set forth in claim 1, said curved plate having an inlet portion aligned with said outlet and an outlet portion aligned with said inlet.

3. In a muffler as set forth in claim 2, said curved plate being wider than said inlet and outlet and being curved in cross section and having a concave side facing said inlet and outlet.

4. In a muffler as set forth in claim 3, said curved plate having a height that is substantially one half the length of the transverse chamber.

5. In a muffler as set forth in claim 2, said curved plate having a centrally located flat portion formed therein which fits against and is secured to said wall means.

6. In a muffler as set forth in claim 1, said curved plate comprising a first curved plate section providing an inlet portion aligned with said outlet and a second curved plate section transversely spaced from the first section and arranged to receive gas from the first and providing an outlet portion aligned with said inlet.

7. In an exhaust gas muffler, a tubular housing having a longitudinal axis, means providing a retroverted gas flow passage in said housing, wall means defining a transverse chamber in the housing, said gas flow passage including a first flow section having an outlet in said chamber and a second flow section having an inlet in said chamber, and a curved flow guide and directing plate means comprising a curved plate mounted on said wall means to extend longitudinally into said chamber toward said outlet and inlet and having an inlet portion arranged to receive gas from said outlet and an outlet portion arranged to deliver gas to said inlet.

8. In an exhaust gas muffler, a tubular housing of oval cross section, means providing a retroverted gas flow passage in said housing, wall means defining first and second transverse chambers in the housing, said gas flow passage including a first section having an outlet in said first transverse chamber, said gas flow passage including a second flow section having an inlet in said first transverse chamber and an outlet in said second transverse chamber, said gas flow passage including a third section having an inlet in said second chamber, a first curved flow guide and directing means comprising a first curved plate mounted on said wall means to extend longitudinally into said first chamber and having an inlet portion aligned with said first flow section outlet to receive gas from it and having an outlet portion aligned with said second flow section inlet to deliver gas to it, a second curved flow guide and directing means comprising a second curved plate mounted on said wall means to extend longitudinally into said second chamber and having an inlet portion aligned with said second flow section outlet to receive gas from it and having an outlet portion aligned with said third flow section inlet to deliver gas to it.

* * * * *